US011022293B2

(12) United States Patent
Portinga et al.

(10) Patent No.: US 11,022,293 B2
(45) **Date of Patent: *Jun. 1, 2021**

(54) ADJUSTABLE OPTIC AND LIGHTING DEVICE ASSEMBLY WITH ELASTIC MEMBER

(71) Applicant: Troy-CSL Lighting Inc., City of Industry, CA (US)

(72) Inventors: Joshua Portinga, City of Industry, CA (US); Vincent Nguyen, Garden Grove City, CA (US)

(73) Assignee: Troy-CSL Lighting Inc., City of Industry, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/897,598

(22) Filed: Jun. 10, 2020

(65) Prior Publication Data

US 2020/0300450 A1 Sep. 24, 2020

Related U.S. Application Data

(63) Continuation of application No. 16/226,526, filed on Dec. 19, 2018, now Pat. No. 10,760,782.

(51) Int. Cl.
*F21V 29/70* (2015.01)
*F21S 8/02* (2006.01)
(Continued)

(52) U.S. Cl.
CPC ..... *F21V 29/70* (2015.01); *F21S 8/026* (2013.01); *F21V 5/045* (2013.01); *F21V 14/06* (2013.01);
(Continued)

(58) Field of Classification Search
CPC ..... F21V 29/20; F21V 5/045; F21V 14/06; F21V 15/01; F21V 29/70; F21V 5/04;
(Continued)

(56) References Cited

U.S. PATENT DOCUMENTS 3,124,309 A 3/1964 Cantoni et al.
5,274,535 A * 12/1993 Gonser ..... F21V 9/20 362/268
(Continued)

FOREIGN PATENT DOCUMENTS

CN 201637870 U 11/2010
CN 201779470 U 3/2011
(Continued)

OTHER PUBLICATIONS

Extended European Search Report dated Apr. 23, 2020, from application No. 19217434.0.
(Continued)

*Primary Examiner* — Anabel Ton
(74) *Attorney, Agent, or Firm* — Foley & Lardner LLP

(57) ABSTRACT

A lighting device assembly includes: a heat sink; a light source attached to one end of the heat sink; an optic assembly configured to pivot an optic about the light source; a housing member having a cavity in which at least a portion of the optic assembly is received; and an elastic member configured to press the optic assembly against the cavity to maintain an adjusted position of the optic.

18 Claims, 9 Drawing Sheets

(51) Int. Cl.

| | |
|---|---|
| ***F21V 5/04*** | (2006.01) |
| ***F21V 14/06*** | (2006.01) |
| ***F21V 21/04*** | (2006.01) |
| ***F21V 15/01*** | (2006.01) |
| ***F21V 21/26*** | (2006.01) |

(52) U.S. Cl.
CPC ..... *F21V 15/01* (2013.01); *F21V 21/04* (2013.01); *F21V 21/26* (2013.01)

(58) Field of Classification Search
CPC . F21V 21/04; F21V 21/06; F21S 8/024; F21S 8/26
See application file for complete search history.

(56) References Cited

U.S. PATENT DOCUMENTS

| | | | | |
|---|---|---|---|---|
| 5,404,297 | A | 4/1995 | Birk et al. | |
| 5,833,346 | A | 11/1998 | Denley | |
| 8,398,271 | B2 | 3/2013 | Chan | |
| 9,255,676 | B2 | 2/2016 | Hoog | |
| 9,618,163 | B2 | 4/2017 | Power et al. | |
| 9,664,353 | B2 | 5/2017 | Maliar et al. | |
| 9,982,855 | B1 | 5/2018 | Tan | |
| 10,145,519 | B1 * | 12/2018 | Portinga | F21V 21/04 |
| 10,378,733 | B1 * | 8/2019 | McLellan | F21S 41/143 |
| 2004/0124487 | A1 | 7/2004 | Loh | |
| 2008/0036397 | A1 | 2/2008 | Hockel et al. | |
| 2008/0074883 | A1 | 3/2008 | Li | |
| 2008/0158894 | A1 | 7/2008 | Dixon et al. | |
| 2009/0290351 | A1 | 11/2009 | Chan | |
| 2011/0164422 | A1 | 7/2011 | Chan | |
| 2011/0267834 | A1 | 11/2011 | Potucek et al. | |
| 2012/0156920 | A1 | 6/2012 | Sakai et al. | |
| 2012/0162985 | A1 * | 6/2012 | Kauffman | F21V 5/007 362/244 |
| 2012/0182723 | A1 | 7/2012 | Sharrah et al. | |
| 2012/0243229 | A1 * | 9/2012 | Cheng | F21S 8/028 362/249.02 |
| 2013/0076269 | A1 | 3/2013 | Shilton | |
| 2013/0107549 | A1 | 5/2013 | Yeh | |
| 2014/0313727 | A1 | 10/2014 | Dupre et al. | |
| 2014/0313737 | A1 * | 10/2014 | Watson | F21V 5/045 362/297 |
| 2014/0355273 | A1 | 12/2014 | Saito | |
| 2015/0092417 | A1 | 4/2015 | Hoog | |
| 2015/0117040 | A1 | 4/2015 | Hartmann et al. | |
| 2015/0300612 | A1 | 10/2015 | Stathes et al. | |
| 2015/0369430 | A1 | 12/2015 | Vamberi | |
| 2016/0025319 | A1 | 1/2016 | Meyer | |
| 2016/0363747 | A1 | 12/2016 | Krijn et al. | |
| 2017/0074488 | A1 * | 3/2017 | Fujisawa | F21S 8/043 |
| 2017/0114984 | A1 | 4/2017 | Dross | |
| 2017/0122534 | A1 * | 5/2017 | Ticktin | F21V 21/002 |
| 2017/0307196 | A1 * | 10/2017 | Matsui | F21V 21/28 |
| 2019/0063736 | A1 * | 2/2019 | Zeng | F21V 14/06 |
| 2020/0132278 | A1 | 4/2020 | Portinga | |
| 2020/0200377 | A1 | 6/2020 | Portinga et al. | |

FOREIGN PATENT DOCUMENTS

| | | | |
|---|---|---|---|
| CN | 201779520 | U | 3/2011 |
| CN | 201982999 | U | 9/2011 |
| CN | 201983139 | U | 9/2011 |
| CN | 202125815 | U | 1/2012 |
| CN | 202132746 | U | 2/2012 |
| CN | 202274433 | U | 6/2012 |
| CN | 103162149 | A | 6/2013 |
| JP | S63-185746 | U | 11/1988 |
| JP | 2007-035381 | A | 2/2007 |
| JP | 4400886 | B2 | 1/2010 |
| JP | 2011-146239 | A | 7/2011 |
| JP | 2011-192494 | | 9/2011 |
| JP | 2012-069370 | A | 4/2012 |
| JP | 6164928 | B2 | 7/2017 |
| WO | WO-01/02775 | | 1/2001 |
| WO | WO-2013/014888 | A1 | 1/2013 |

OTHER PUBLICATIONS

Final Office Action dated Mar. 24, 2020, from U.S. Appl. No. 15/828,243.

Hung, et al., "Digital LED Desk Lamp with Automatic Uniform Illumination Area by Using Two Accelerometers and Halftone Method" IEEE ISCE 2014 1569933999.

ITO, Lighting System and Fresnel Lens, Sep. 29, 2011, JP2011192494A, English (Year: 2011).

Minebea, "A revolutionary lighting able to completely control light, created by combining the application of optical technology with precision components", 2017, http://www.minebeamitsumi.com/english/strengths/column/saliot/index.html.

Minebea, "Minebea to Start Mass Production and Sales of New LED Lighting (Smart Adjustable Light for IoT (SALIOT))", Jul. 15, 2015 Press Release, http://www.minebeamitsumi.com/english/news/press/2015/1189602_7564.html.

Non-Final Office Action dated Dec. 2, 2019, from U.S. Appl. No. 16/226,526.

Non-Final Office Action dated Feb. 5, 2020, from U.S. Appl. No. 16/175,470.

Non-Final Office Action dated Sep. 9, 2019, from U.S. Appl. No. 15/828,243.

Notice of Allowance dated Mar. 26, 2020, from U.S. Appl. No. 16/226,526.

Notice of Allowance dated Oct. 2, 2018, from U.S. Appl. No. 15/984,008.

Office Action dated Jul. 5, 2018, from U.S. Appl. No. 15/984,008.

Final Office Action dated Jun. 12, 2020, from U.S. Appl. No. 16/175,470.

Notice of Allowance dated Jul. 30, 2020, from U.S. Appl. No. 15/828,243.

Notice of Allowance dated Nov. 2, 2020, from U.S. Appl. No. 16/175,470.

Notice of Allowance dated Jan. 13, 2021, from U.S. Appl. No. 16/808,102.

Canadian Examiner's Report dated Feb. 24, 2021, from application No. 3065244.

Chinese Office Action dated Feb. 26, 2021, from application No. 201911317518.7.

European Office Action dated Feb. 22, 2021, from application No. 19217434.0.

* cited by examiner

ADJUSTABLE OPTIC AND LIGHTING DEVICE ASSEMBLY WITH ELASTIC MEMBER

CROSS-REFERENCE TO RELATED APPLICATIONS AND CLAIM OF PRIORITY

This application is a Continuation Application of U.S. patent application Ser. No. 16/226,526, filed Dec. 19, 2018, the content of which are fully incorporated herein by reference in its entirety.

BACKGROUND

Lighting devices such as, but not limited to, track lights, can include configurations that allow for adjustment of the direction of emitted light or light beam. Such lighting devices may include a light source, such as a light emitting diode (LED). Typically, the brightness of an LED light source is directly related to the speed in which heat can be transferred away from the LED component, which should desirably be maintained under about 105° Celsius. However, if the LED component is mounted on a moveable structure, such as a free-floating fixture head that is movable to adjust a light beam direction, heat may not be efficiently transferred from the LED component through the moveable structure. Therefore, the brightness of light emitted from the LED light source may be reduced.

If the lighting device has a light source that is mounted directly to a fixture housing of substantial mass and suitable heat conductive material, the fixture housing may help to dissipate heat away from the LED light source, to improve LED performance. However, in lighting devices having light sources fixed to fixture housings of sufficient mass for heat dissipation, it may not be possible to adjust the direction of a downlight beam. In addition, if the lighting device includes a fixture head that is moveable together with the optics to adjust the direction of emitted light, some light may be blocked by the bezel or housing containing the optics and light source, when the fixture head is moved.

SUMMARY

This application is related to U.S. application Ser. No. 15/984,008 (now U.S. Pat. No. 10,145,519), filed on May 18, 2018, which is a continuation of U.S. application Ser. No. 15/828,234, filed on Nov. 30, 2017, both of which are incorporated by reference in their entirety herein. This application is also related to U.S. application Ser. No. 16/175,470, filed on Oct. 30, 2018, which is incorporated by reference in its entirety herein.

One or more examples and aspects described herein relate to an optic assembly having an adjustable optic in which loss of light is reduced. Other examples and aspects described herein relate to a lighting device and a lighting device assembly including that optic assembly. One or more examples and aspects described herein relate to an optic assembly having an adjustable optic, a lighting device or a lighting device assembly that includes that optic and has improved heat transfer characteristics.

According to an example embodiment, a lighting device assembly includes: a heat sink; a light source attached to one end of the heat sink; an optic assembly configured to pivot an optic about the light source; a housing member having a cavity in which at least a portion of the optic assembly is received; and an elastic member configured to press the optic assembly against the cavity to maintain an adjusted position of the optic.

In some embodiments, the optic assembly may include an exterior surface configured to slideably engage the elastic member when the optic is moved.

In some embodiments, a portion of the elastic member may be configured to surround a portion of the optic assembly.

In some embodiments, the elastic member may include an eyelet configured to receive the portion of the optic assembly.

In some embodiments, the elastic member may include a spring.

In some embodiments, the spring may be a wave disk spring, a wave spring, a disk spring, a flat wire spring, or a coil spring.

In some embodiments, the exterior surface of the optic assembly may have a first curvature that is configured to slideably engage with a curved surface of the cavity, and a second curvature that is configured to slideably engage with the elastic member.

In some embodiments, the optic assembly may include: a holding member having an interior volume in which the optic is contained; and a locking member configured to lock the optic in a position within the holding member, the locking member having an opening configured to receive the light source extended therein by the heat sink.

In some embodiments, the holding member may include an exterior surface corresponding to the first curvature, and the locking member may include an exterior surface corresponding to the second curvature.

In some embodiments, the holding member may include an exterior surface having a first surface portion corresponding to the first curvature and a second surface portion corresponding to the second curvature.

In some embodiments, the heat sink may have a first width at the one end attached to the light source and a second width at an opposite end, the second width being smaller than the first width.

In some embodiments, the opposite end of the heat sink may be configured to receive an edge portion of the optic assembly when the optic is pivoted.

In some embodiments, at least one of an outer surface of the optic assembly and the cavity of the housing member may include a friction material that provides a friction surface between the optic assembly and the cavity when the outer surface of the optic slideably engages the cavity of the housing member.

In some embodiments, the lighting device assembly may be configured to be mounted to a structure, and the optic may be configured to pivot about the light source while the heat sink is stationary relative to the structure.

According to another embodiment, an optic assembly configured to pivot an optic about a light source, includes: a holding member having an interior volume configured to contain the optic; and a locking member configured to lock the optic in a position within the holding member, the locking member having an opening configured to receive the light source attached to an end of a heat sink. The optic assembly is configured to pivot the optic about the light source by slideably engaging a cavity of a housing member in which at least a portion of the optic assembly is received, and by slideably engaging an elastic member configured to press the optic assembly against the cavity.

In some embodiments, an exterior surface of the optic assembly may have a first curvature that is configured to slideably engage with a curved surface of the cavity, and a second curvature that is configured to slideably engage with the elastic member.

In some embodiments, the holding member may include an exterior surface corresponding to the first curvature, and the locking member may include an exterior surface corresponding to the second curvature.

In some embodiments, at least a portion of the locking member may be configured to be received within an eyelet of the elastic member.

In some embodiments, the holding member may include an exterior surface having a first surface portion corresponding to the first curvature and a second surface portion corresponding to the second curvature.

In some embodiments, at least a portion of the second surface portion may be configured to be received within an eyelet of the elastic member.

BRIEF DESCRIPTION OF THE DRAWINGS

The above and other aspects and features of the present invention will become more apparent to those skilled in the art from the following detailed description of the example embodiments with reference to the accompanying drawings, in which.

DETAILED DESCRIPTION

Figure 1A:
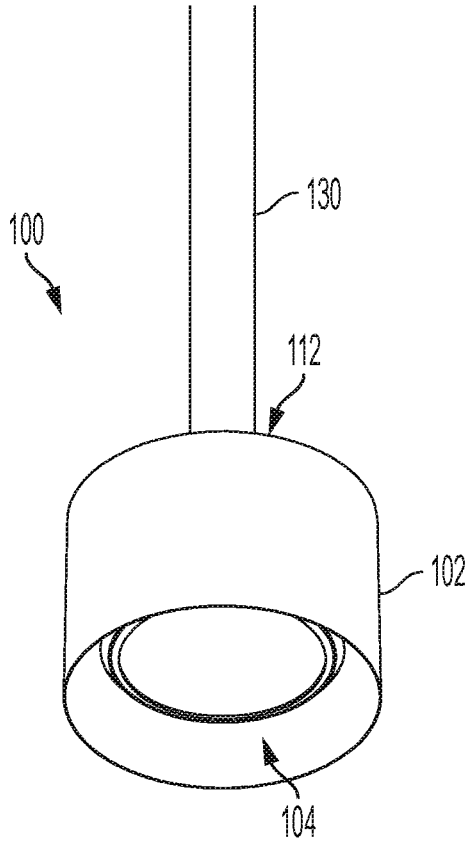
FIGS. 1A-1D are perspective views of a lighting device assembly according to various example embodiments.

Hereinafter, example embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. Further, features or aspects within each example embodiment should typically be considered as available for other similar features or aspects in other example embodiments.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

According to various embodiments, an adjustable lighting device with an elastic member is provided to simplify and improve the adjustability of an optic about a stationary light source and heat sink. In some embodiments, an adjustable lighting device with an improved heat sink is provided for transferring heat away from the light source. In some embodiments, an adjustable lighting device with an improved heat sink is provided for increasing the adjustable movement of the optic.

Figure 1B:
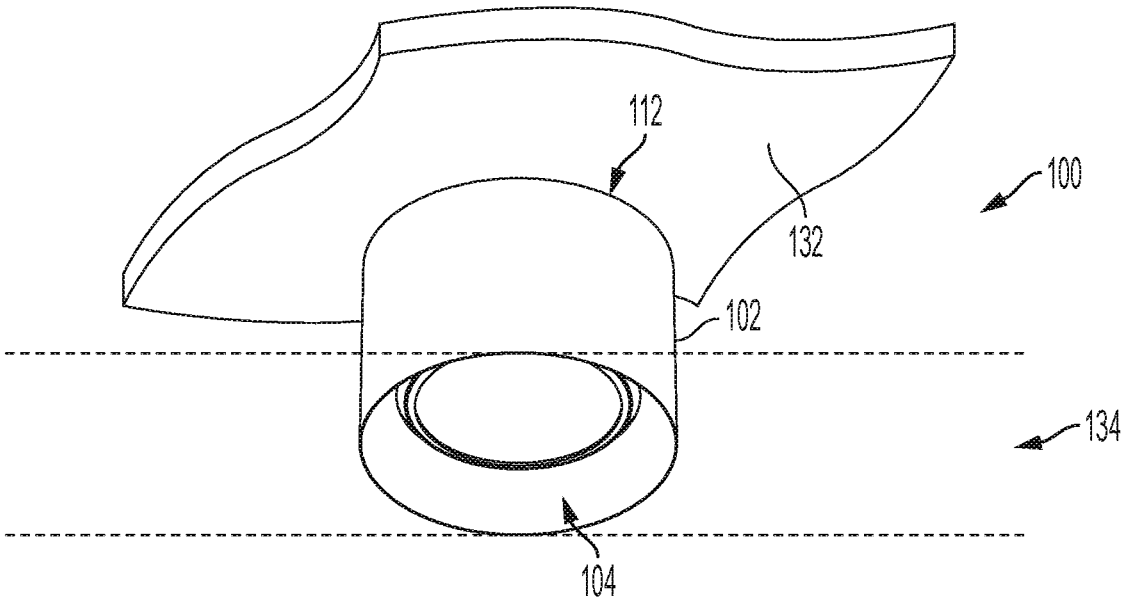

FIGS. 1A through 1D are perspective views of four examples of a lighting device assembly according to various embodiments of the present invention, where like elements in those drawings are labeled with like reference numbers. Referring to FIGS. 1A and 1B, the lighting device assembly 100 may include a housing member (or a bezel) 102, an optic assembly 104, and a top member (e.g., a mounting bracket) 112. The optic assembly 104 may pivot and/or rotate within the housing member 102 to adjust a direction of emitted light. While FIGS. 1A and 1B show that the housing member 102 generally has a cylindrical shape, other embodiments may include housing members 102 having other suitable shapes, including but not limited to curved or partially spherical shapes, conical, cube or cuboid shapes, rectangular shapes, triangular shapes, or the like.

Figure 1C:
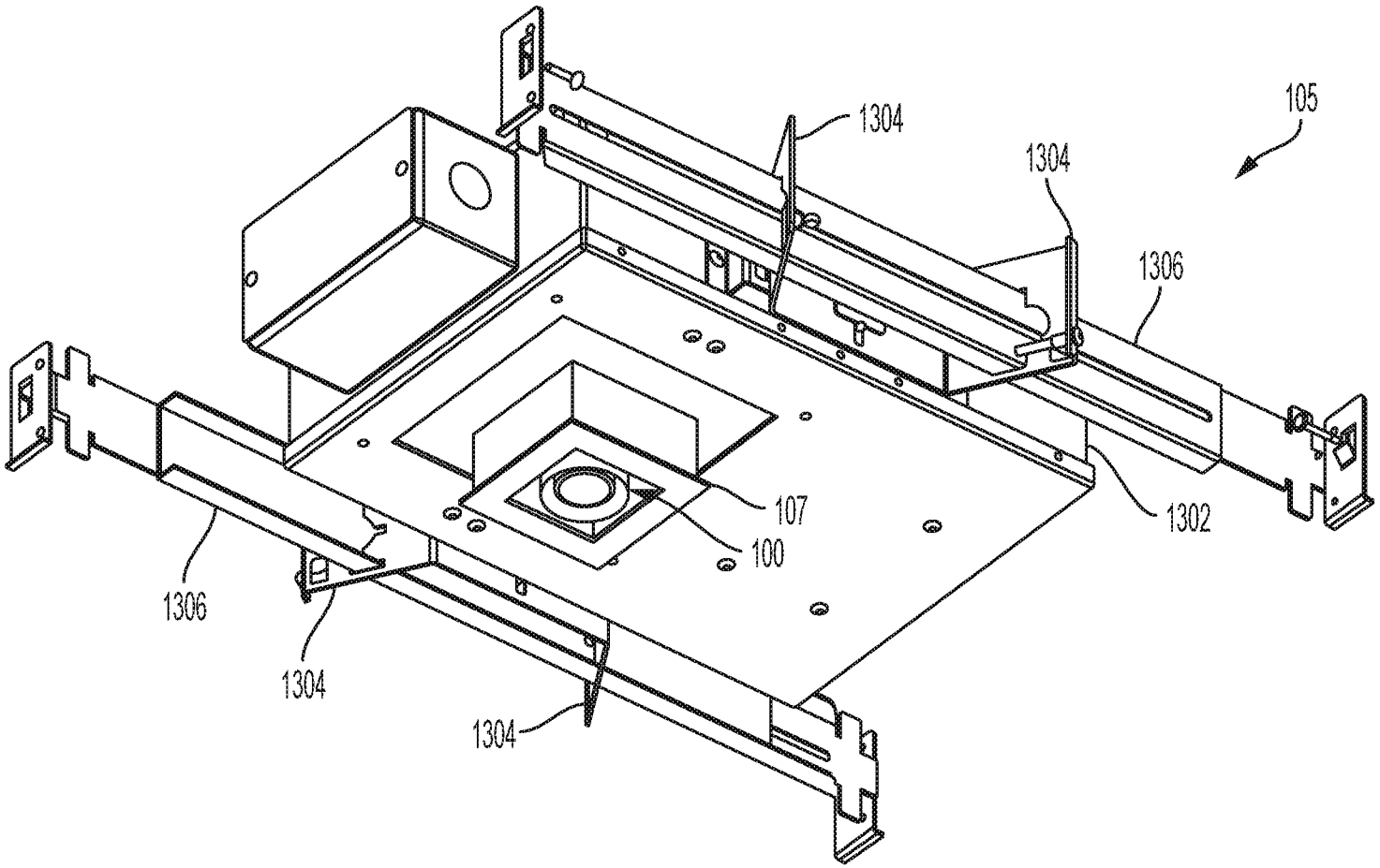
Figure 1D:
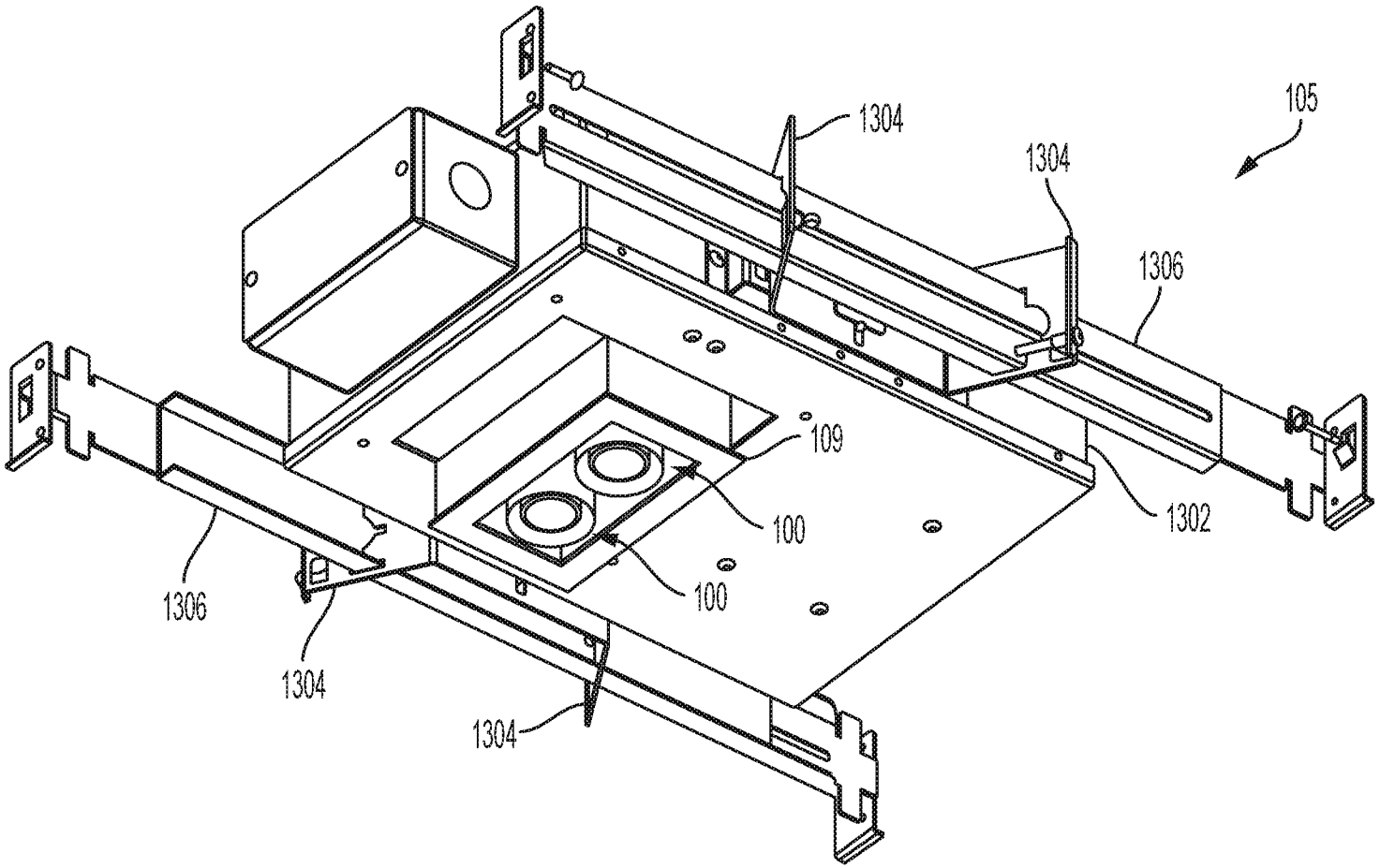

In various embodiments, the lighting device assembly 100 may be mounted to various structures and/or incorporated into various structures. For example, as shown in FIG. 1A, the lighting device assembly 100 may be attached to an end of an extension member (e.g., a rod or pole) 130, as in the case of a pendent light, desk light, lamp, and the like. In some other examples, as shown in FIG. 1B, the lighting device assembly 100 may be mounted to a surface of an object (such as, but not limited to, a fixture housing, track lighting, downlights, linear lights, board, ceiling, wall, floor, and the like) 132, or may be recessed into a surface of an object (such as, but not limited to a ceiling, wall, floor, shelf, cabinet, and the like) 134. In yet other examples, as shown in FIGS. 1C and 1D, one or more lighting device assemblies 100 may be mounted on (or within) a fixture housing 105. For example, as shown in FIG. 1C, one lighting device assembly 100 may be mounted within a single light fixture frame member 107 of the fixture housing 105, or as shown in FIG. 1D, two or more lighting device assemblies 100 may be mounted within a multi-light fixture frame member 109 of the fixture housing 105. Further, in various embodiments, a plurality of lighting device assemblies 100 may be arranged in various combinations as desired.

In some embodiments, the fixture housing 105 may facilitate the mounting of one or more lighting device assemblies 100 within various spaces. For example, referring to FIGS. 1C and 1D, the fixture housing 105 includes an isolation body 1302 to house one or more fixture frame members 107 and/or 109 having one or more lighting device assemblies 100 of the embodiments of the present invention mounted therein. The isolation body 1302 is connected to a plurality of adjustable brackets 1304 for mounting on a plurality of male and female slippers 1306. The male and female slippers 1306 may be expanded or collapsed to mount the isolation body 1302 within various spaces. According to various embodiments, since heat sinks 108 of the lighting device assemblies 100 remain stationary even when the optic 120 is pivoted or rotated, a depth of the isolation body 1302 may be smaller than those of comparative housings where the heat sink is moved to adjust a direction of light. Accordingly, the isolation body 1302 of the fixture housing 105 may have a lower profile than those of comparative housings. While FIGS. 1A through 1D show four examples of lighting device shapes and relative dimensions, other embodiments have other suitable shapes and relative dimensions.

Figure 2A:
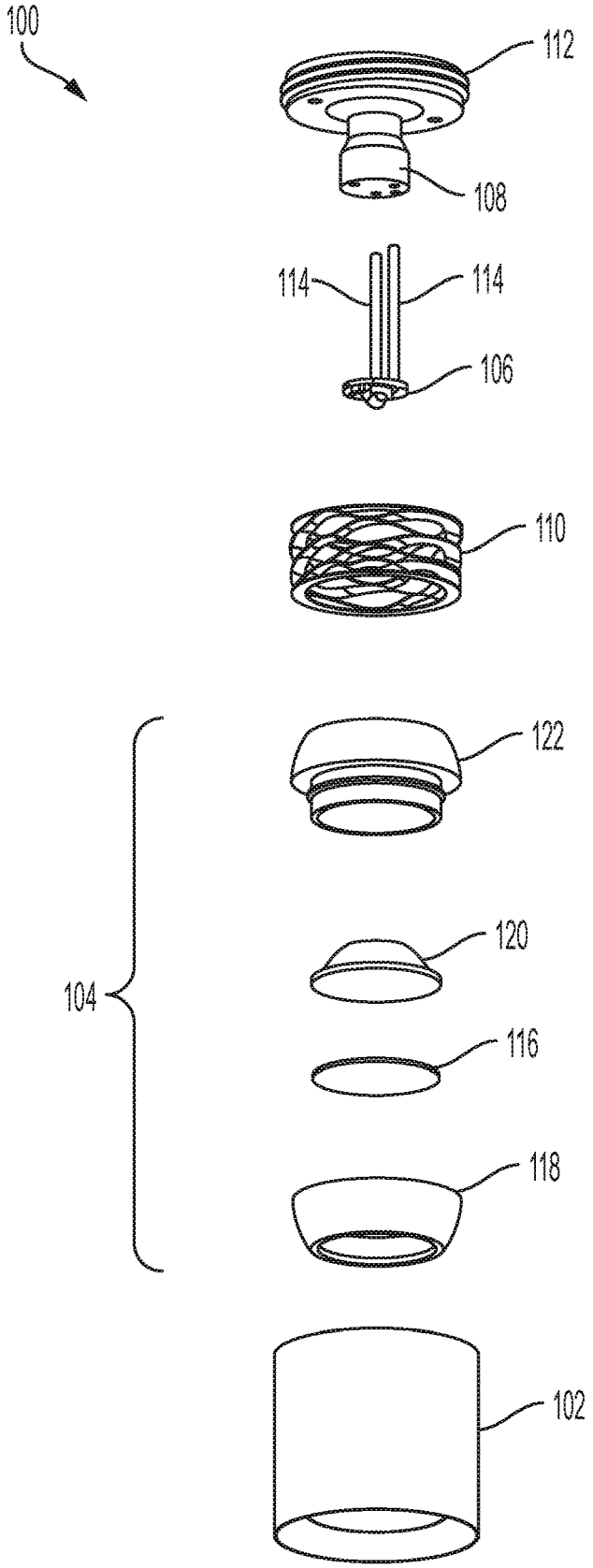
FIGS. 2A and 2B are exploded views of a lighting device assembly according to various example embodiments.
Figure 2B:
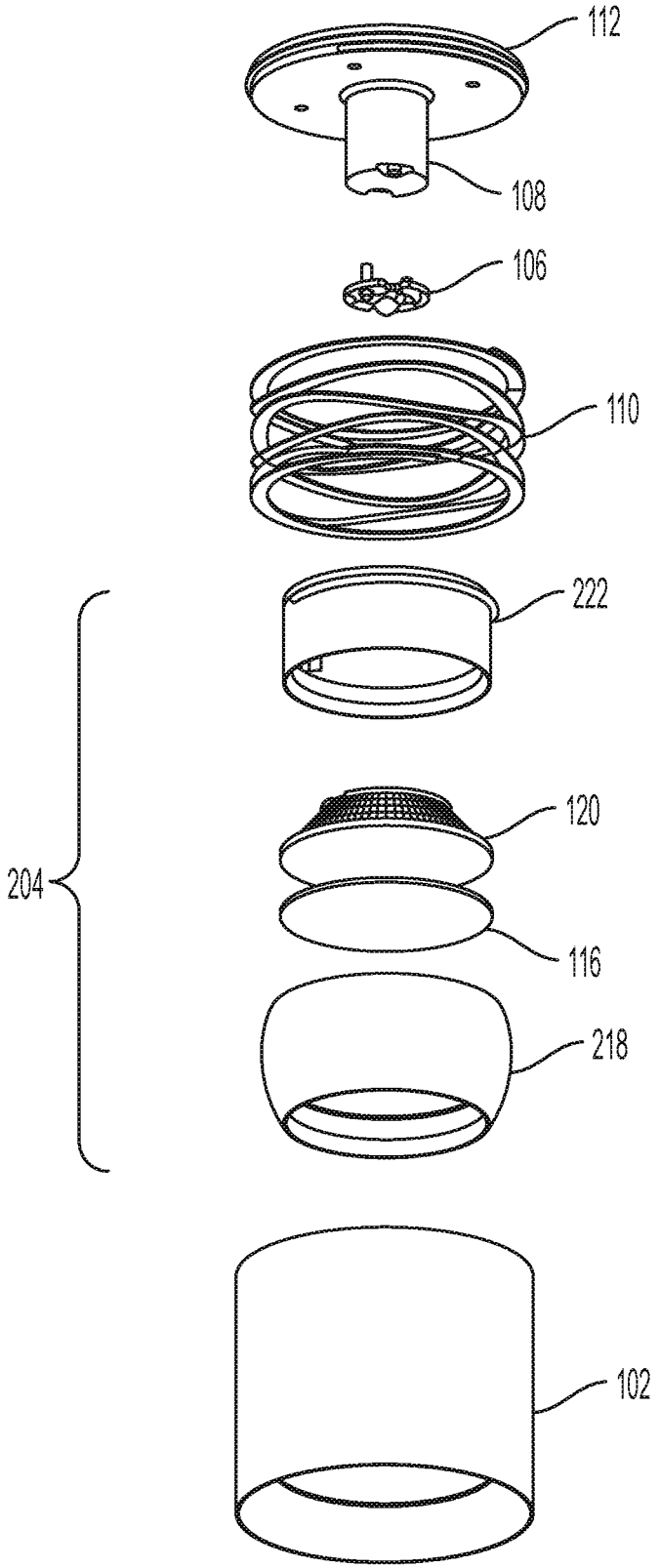

FIGS. 2A and 2B are exploded views of a lighting device assembly 100 according to various embodiments of the present invention. Referring to FIGS. 2A and 2B, in various embodiments, the lighting device assembly 100 may include the housing member 102, an optic assembly (e.g., 104 or 204), an elastic member 110, a light source assembly 106, a heat sink 108, and the top member 112. In various embodiments, the optic assembly (e.g., 104 or 204) may include a lens filter 116, a holding member (e.g., 118 or 218), an optic 120 (one or more lens, filter or combination thereof), and a locking member (e.g., 122 or 222). Accordingly, the lighting device assembly 100 shown in FIG. 2B may be the same or similar to the lighting device assembly 100 shown in FIG. 2A, except the structure, size, and/or shape of some of the components (e.g., the optic assembly 104 and 204) may be variously modified. Thus, the features or aspects described herein with reference to one or more of the various embodiments shown in FIGS. 2A and 2B should typically be considered as available for other similar features or aspects described with reference to other ones of the various embodiments shown in FIGS. 2A and 2B.

In more detail, as shown in FIG. 2A, in some embodiments, the lighting device assembly 100 may include the housing member 102, an optic assembly 104, the elastic member 110, the light source assembly 106, the heat sink 108, and the top member 112. In some embodiments, the optic assembly 104 may include the lens filter 116, a holding member 118, the optic 120 (one or more lens, filter or combination thereof), and a locking member 122. In various embodiments, the lens filter 116 may change a characteristic of emitted light (e.g., color, brightness, focus, polarization, linear spread filter, wall wash filter, baffles, glare guards, snoots, and/or the like). However, the present invention is not limited thereto, and in other embodiments, the lens filter 116 may be formed as a part of the optic 120, or the lens filter 116 may be optional or omitted. In various embodiments, each of the housing member 102, the holding member 118, and the locking member 122 may be formed or include any suitable material, for example, metal, plastic, glass, ceramic, and/or the like, or any suitable composite material thereof.

The holding member 118 receives the optic 120 (and the optional lens filter 116), and may facilitate the movement (e.g., pivot and/or rotation) of the optic 120 within the housing member 102. For example, the holding member 118 may slideably engage a cavity of the housing member 102 in a ball and socket manner. In various embodiments, the holding member 118 may have an outer surface having a curvature that is held within a corresponding cavity (with a corresponding mating curvature and dimension) within the housing member 102. For example, the outer surface of the holding member 118 may have a shape of a portion of a sphere (e.g., a lower hemisphere portion), and may be held within a corresponding sphere-shaped cavity within the housing member 102. Accordingly, in various embodiments, the optic 120 may pivot in any direction (e.g., on a 360 degree plane) within the housing member 102, by slideably engaging the cavity of the housing member 102 via the holding member 118. However, the present invention is not limited thereto, and in another embodiment, the pivoting directions of the optic 120 may be limited or reduced, for example, by providing stop surfaces or a shape of the surface of the holding member 118 and/or a shape of the cavity within the housing member 102, that limits movement in one or more directions.

In various embodiments, the locking member 122 may lock the optic 120 and the optional lens filter 116 within the holding member 118. For example, still referring to FIG. 2A, in some embodiments, the locking member 122 may have an upper portion and a lower portion. The lower portion of the locking member 122 may have a tubular (or ring) shape that extends from the upper portion toward the holding member 118 to mate with the holding member 118. For example, the lower portion of the locking member 122 may lock (e.g., twist-lock) the optic 120 and the optional lens filter 116 at a suitable position within the holding member 118. In various embodiments, the locking member 122 may include an opening through which the light source assembly 106 and/or the heat sink 108 is received to enable pivoting or rotation of the optic 120 about the light source assembly 106 and/or the heat sink 108.

In various embodiments, the elastic member 110 may be a spring (e.g., a wave disk spring, wave spring, disk spring, flat wire spring, coil spring, and/or the like), that exerts a force on the optic assembly 104 (e.g., the upper portion of the locking member 122) to press the optic assembly 104 (e.g., the holding member 118) against the sphere-shaped cavity within the housing member 102. In other embodiments, the elastic member 110 may include a resilient material or other structure that imparts a bias force on the optic assembly 104 as described herein. For example, in various embodiments, when the optic 120 is pivoted or rotated about the light source assembly 106 and/or the heat sink 108, the optic assembly 104 (having the optic 120) can be pressed towards the elastic member 110 to pivot or rotate the optic 120 to a desired position. Once the optic 120 is at the desired position (and the optic assembly 104 is released from the pressed state), the elastic member 110 extends toward a natural state to exert a force on the optic assembly 104, and presses the holding member 118 of the optic assembly 104 against the cavity within the housing member 102, thereby holding the optic 120 at the desired position. In various embodiments, the elastic member 110 may include or be formed of any suitable material having elasticity and resiliency, for example, such as metal, plastic, or any suitable composite material.

For example, in some embodiments, the upper portion of the locking member 122 may slideably engage an eyelet (e.g., opening, through-hole, groove, or recess) in the elastic member 110, such as in a ball and socket manner. In some embodiments, the upper portion of the locking member 122 may have an outer surface having a curvature so that the upper portion of the locking member 122 is partially received in the eyelet of the elastic member 110. For example, in some embodiments, the outer surface of the upper portion of the locking member 122 may have a shape corresponding to a portion of a sphere (e.g., an upper hemisphere portion) that is partially held within the eyelet of the elastic member 110 such that a portion of the elastic member 110 surrounds a portion of the upper portion of the locking member 122. In this case, when the optic assembly 104 is pivoted, the curvature of the upper portion of the locking member 122 slideably engages the eyelet to remain within the eyelet of the elastic member 110 so that the force exerted thereon by the elastic member 110 can be distributed around the upper portion of the locking member 122 to hold the optic assembly 104 at the desired position.

In some embodiments, at least one of the outer surface of the holding member 118 or an interior surface of the cavity of the housing member 102 may include a friction member or a friction material coating to provide a friction surface to maintain a pivoted position of the optic 120 and the optic assembly 104 within the housing member 102. For example, when the optic 120 is pressed and pivoted (with the holding member 118) to a desired position within the housing member 102 and then released, the elastic member 110 presses the optic assembly 104 (with the holding member 118) against the interior surface of the cavity of the housing member 102 so that the engaging surfaces thereof frictionally engages the friction surface, to prevent or substantially prevent the holding member 118 from shifting (or sliding) to a different position from the desired position due to gravity (i.e., without manual force) or due to the force exerted by the elastic member 110. Preferably, the frictional force may be overcome by manual force applied to manually adjust or move (pivot and/or rotate) the optic 120 and the holding member 118 relative to the housing member 102. Accordingly, the friction member or the friction material coating of the engaging surfaces of the holding member 118 and/or the interior surface of the cavity of the housing member 102 may include any suitable material to provide the friction surface, for example, but not limited to, silicone, rubber, and/or the like. In further examples, the friction surface of the engaging surfaces of the holding member 118 and/or the cavity of the housing member 102 includes contour, roughness or other features that enhance friction. However, the present invention is not limited thereto, and the friction surface or friction material coating may be omitted.

Referring to FIG. 2B, the lighting device assembly 100 may include the housing member 102, an optic assembly 204, the elastic member 110, the light source assembly 106, the heat sink 108, and the top member 112. In some embodiments, the optic assembly 204 may include the optional lens filter 116, a holding member 218, the optic 120 (one or more lens, filter or combination thereof), and a locking member 222. In various embodiments, each of the housing member 102, the holding member 218, and the locking member 222 may be formed or include any suitable material, for example, metal, plastic, glass, ceramic, and/or the like, or any suitable composite material thereof. In some embodiments, the optic assembly 204 may be similar to the optic assembly 104 shown in FIG. 2A. However, as shown in FIG. 2B, the holding member 218 includes an outer surface having a lower surface portion and an upper surface portion. The lower surface portion has a shape corresponding to the outer surface of the holding member 118 (e.g., a lower hemisphere portion of the sphere) shown in FIG. 2A, and the upper surface portion has a shape corresponding to the outer surface of the upper portion of the locking member 122 (e.g., an upper hemisphere portion of the sphere) shown in FIG. 2A.

Accordingly, in some embodiments, the locking member 222 may lock the optic 120 and the optional lens filter 116 within the holding member 218. For example, the locking member 222 may have a tubular (or ring) shape, and may lock (e.g., twist-lock) the optic 120 (and the optional lens filter) at a suitable position within the holding member 218. In various embodiments, the locking member 222 may include an opening through which the light source assembly 106 and/or the heat sink 108 is received to enable pivoting or rotation of the optic 120 about the light source assembly 106 and/or the heat sink 108. However, in other embodiments, the locking member 222 may be omitted. For example, in other embodiments, the optic 120 may have a self-locking (e.g., twist-lock) mechanism to be locked within the holding member 218, and in this case, the locking member 222 may be omitted.

Still referring to FIG. 2B, in some embodiments, the holding member 218 receives the optic 120 (and the optional lens filter 116), and may facilitate the movement (e.g., pivot and/or rotation) of the optic 120 within the housing member 102. For example, the lower surface portion of the outer surface of the holding member 218 may slideably engage a cavity (with a corresponding mating curvature and dimension) of the housing member 102 in a ball and socket manner. Accordingly, in various embodiments, the optic 120 may pivot in any direction (e.g., on a 360 degree plane) within the housing member 102, by slideably engaging the cavity of the housing member 102 via the holding member 218. The upper surface portion of the outer surface of the holding member 218 may slideably engage the eyelet (e.g., through-hole, groove, or recess) of the elastic member 110 in a ball and socket manner. Thus, in some embodiments, the upper surface portion of the holding member 218 may have the curvature (e.g., upper hemisphere portion) that is partially held within the eyelet of the elastic member 110 such that a portion of the elastic member 110 surrounds a portion of the upper surface portion of the holding member 218. In this case, when the optic assembly 204 is pivoted, the curvature of the upper surface portion slideably engages the eyelet to remain within the eyelet of the elastic member 110 so that the force exerted thereon by the elastic member 110 can be distributed around the upper surface portion to hold the optic assembly 204 at the desired position.

In some embodiments, at least one of the outer surface of the holding member 218 or an interior surface of the cavity of the housing member 102 may include a friction member or a friction material coating to provide a friction surface to maintain a pivoted position of the optic 120 and the optic assembly 204 within the housing member 102. For example, when the optic 120 is pressed and pivoted (with the holding member 218) to a desired position within the housing member 102 and then released, the elastic member 110 presses the optic assembly 204 (with the holding member 218) against the interior surface of the cavity of the housing member 102 so that the engaging surfaces thereof frictionally engages the friction surface, to prevent or substantially prevent the holding member 218 from shifting (or sliding) to a different position from the desired position due to gravity (i.e., without manual force) or due to the force exerted by the elastic member 110. Preferably, the frictional force may be overcome by manual force applied to manually adjust or move (pivot and/or rotate) the optic 120 and the holding member 218 relative to the housing member 102. Accordingly, the friction member or the friction material coating of the engaging surfaces of the holding member 218 and/or the interior surface of the cavity of the housing member 102 may include any suitable material to provide the friction surface, for example, but not limited to, silicone, rubber, and/or the like. In further examples, the friction surface of the engaging surfaces of the holding member 218 and/or the cavity of the housing member 102 includes contour, roughness or other features that enhance friction. However, the present invention is not limited thereto, and the friction surface or friction material coating may be omitted.

Referring generally to FIGS. 2A and 2B, in various embodiments, the light source assembly 106 may include a light source and a circuit board to connect the light source to one or more wires 114 for powering the light source. The light source may include, for example, one or more light emitting diodes (LEDs), or an array of multiple LEDs. However, the present invention is not limited thereto, and in other embodiments, the light source may include any suitable light source (e.g., LED, incandescent, halogen, fluorescent, combinations thereof, and/or the like). In some embodiments, the light source may emit white light. In other embodiments, the light source may emit any suitable color or frequency of light, or may emit a variety of colored lights. For example, when the light source includes an array of LEDs, each of the LEDs (or each group of plural groups of LEDs in the array) may emit a different colored light (such as, but not limited to white, red, green, and blue), and, in further embodiments, two or more of the different colored lights may be selectively operated simultaneously to mix and produce a variety of different colored lights, or in series to produce light that changes in color over time.

In various embodiments, the light source assembly 106 may be attached (or mounted) to the heat sink 108 via the circuit board and one or more attachment elements. For example, in some embodiments, the circuit board having the light source mounted thereon may be connected to the heat sink 108 via the attachment elements. In another example, the circuit board may have a frame shape that is arranged over the light source, and connected to the heat sink 108 via the attachment elements with the light source interposed therebetween. The attachment elements may include one or more of any suitable attachment elements, for example, a screw, a nail, a clip, an adhesive, and/or the like. However, the present invention is not limited thereto, and in other embodiments, the circuit board may be omitted, and the light source may be directly attached (or mounted) to the heat sink 108.

In various embodiments, the heat sink 108 may draw heat away from the light source of the light source assembly 106. Accordingly, the heat sink 108 may be made of any suitable material, composition, or layers thereof having sufficient heat transfer and/or dissipation qualities, for example, aluminum, copper, and/or the like. In an example embodiment, the heat sink 108 may be formed (e.g., cast) from solid aluminum. The heat sink 108 may have a shape corresponding to an elongated body (e.g., a pedestal) that extends from the top member 112 through the opening of the locking member 122 or 222.

In some embodiments, the heat sink 108 and the top member 112 may be formed (e.g., cast) as a unitary member. In this case, manufacturing and assembly costs may be reduced, and heat transfer characteristics may be improved. However, the present disclosure is not limited thereto, and in other embodiments, the heat sink 108 and the top member 112 may be separately formed and then subsequently connected (or attached) together during an assembly process. In some embodiments, the heat sink 108 may be in direct contact with the light source assembly 106 (and, in particular, with the light source) and may extend the light source assembly 106 at least partially into the opening of the of the locking member 122 or 222.

In particular embodiments, the heat sink 108 holds the light source assembly 106 in a position in which the light source assembly 106 remains fully within the opening of the locking member 122 or 222 with respect to a recess of the optic 120, throughout the full range of adjustable movement (e.g., pivot and/or rotation) of the optic 120 with the holding member 118 or 218. In other embodiments, the light source assembly 106 is held in a position in which the light source assembly 106 remains fully within the recess of the optic 120, throughout the full range of adjustable movement (e.g., pivot and/or rotation) of the optic 120 with the holding member 118 or 218. In still other embodiments, the light source assembly 106 is held in a position in which the light source assembly 106 remains within the opening of the locking member 112 or 222 and/or the recess of the optic 120, throughout some, but not the full extent of motion of the optic 120 with the holding member 118 or 218. In an example embodiment, the heat sink 108 may also be partially extended into the opening of the locking member 122 or 222 and/or the recess of the optic 120, and may remain at least partially within the opening of the locking member 122 or 222 and/or the recess of the optic 120 throughout the full range of adjustable movement (e.g., pivot and/or rotation) of the optic 120 with the holding member 118 or 218.

Figure 5A:
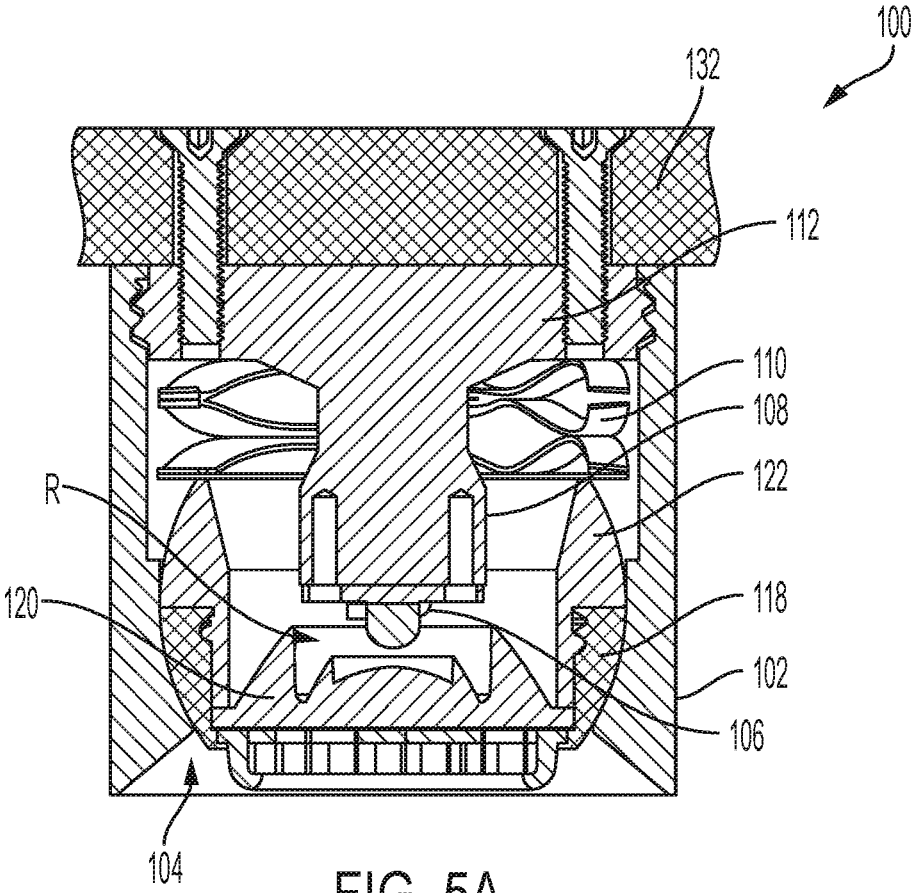
FIG. 5A is a cross-sectional view of the lighting device shown in FIG. 2A with the optic in a first position according to an example embodiment.
Figure 5B:
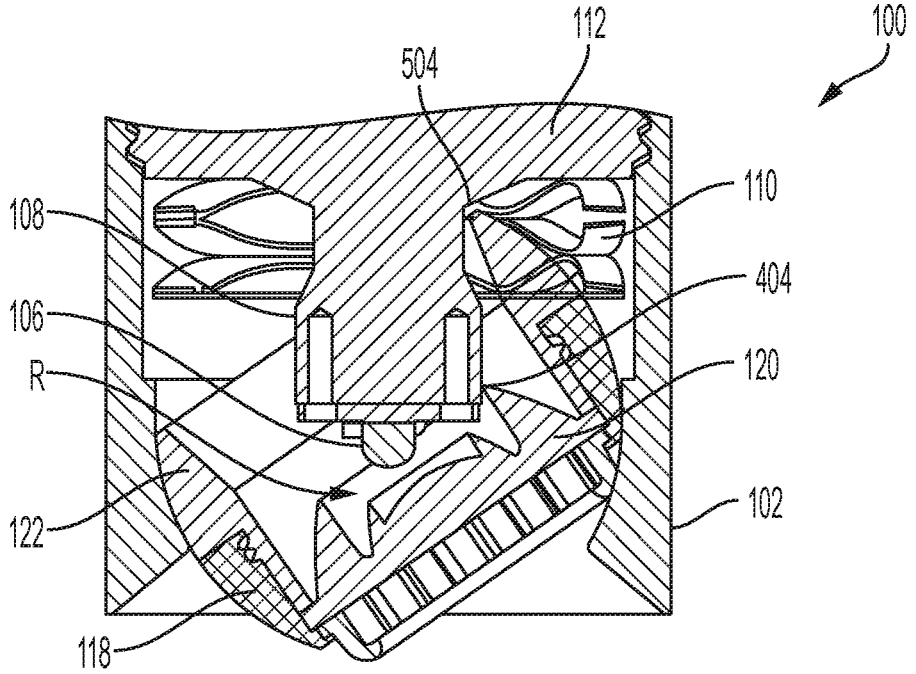
FIG. 5B is a cross-sectional view of the lighting device in FIG. 5A with the optic in a second position according to an example embodiment.
Figure 6A:
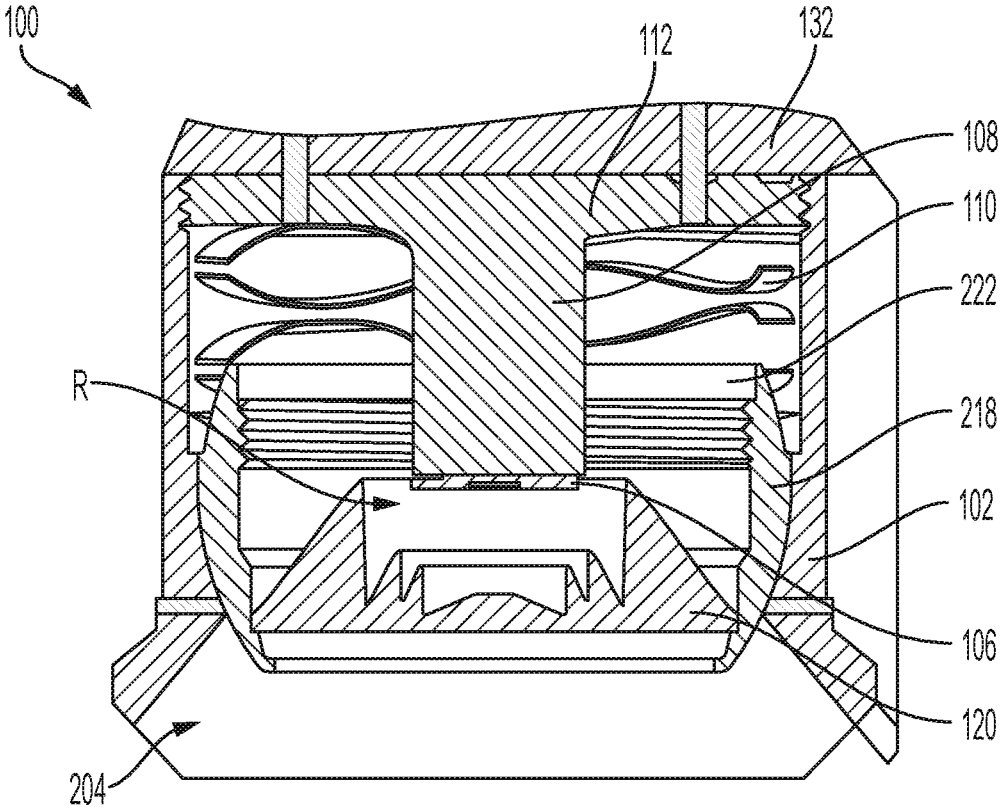
FIG. 6A is a cross-sectional view of the lighting device shown in FIG. 2B with the optic in a first position according to an example embodiment.
Figure 6B:
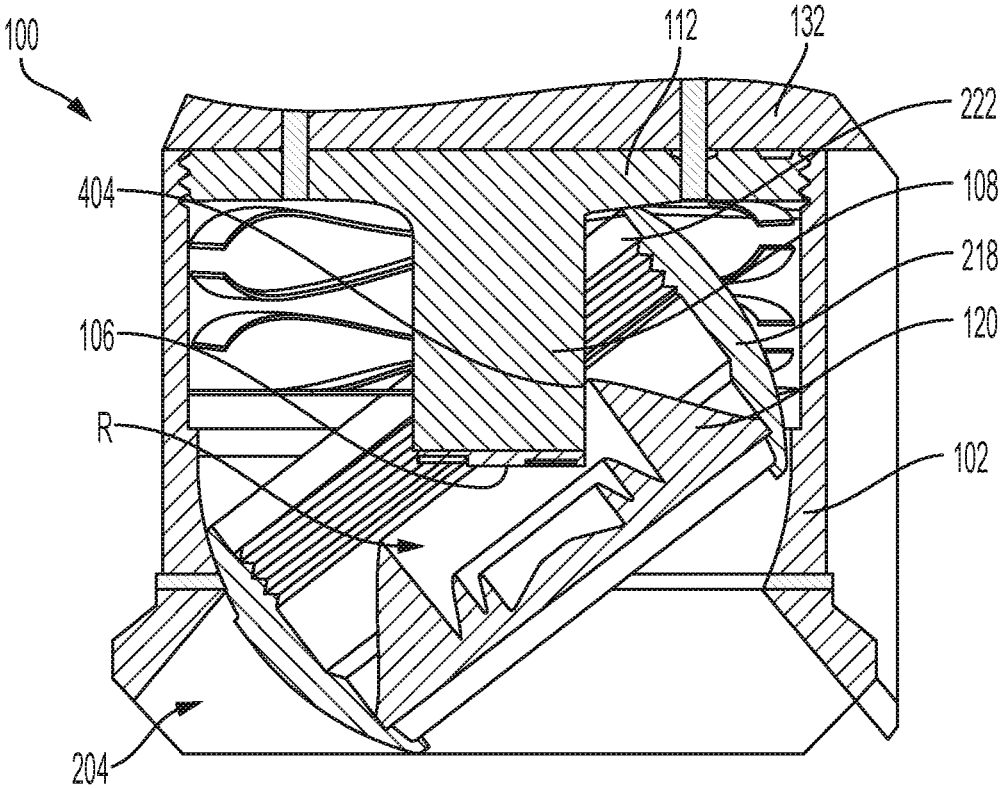
FIG. 6B is a cross-sectional view of the lighting device in FIG. 6A with the optic in a second position according to an example embodiment.

In various embodiments, the heat sink 108 may be sized and/or shaped corresponding to size considerations of the lighting device assembly 100 (e.g., size considerations of the housing member 102, the light source assembly 106, the recess of the optic 120, and/or the like) and/or the desired range of adjustable motion (e.g., pivot and/or rotation) of the optic 120. For example, a size of an end of the heat sink 108 on which the light source assembly 106 is attached may correspond to a size of the light source assembly 106 (e.g., the area of the circuit board of the light source assembly 106). In another example, as shown in FIGS. 2A, 5A, and 5B, the heat sink 108 may have a larger circumference (or larger area) at the end where the light source assembly 106 is attached than at an opposite end (e.g., the end extending from or otherwise attached to the top member 112). In this case, the range of adjustable motion (e.g., pivot and/or rotation) of the optic 120 may be increased by providing additional room at the smaller end in which the optic assembly 104 can pivot (or rotate). However, the present invention is not limited thereto, and in other embodiments, as shown in FIGS. 2B, 6A, and 6B, the heat sink 108 may have a constant circumference (or width) along the length of the heat sink 108.

Figure 3:
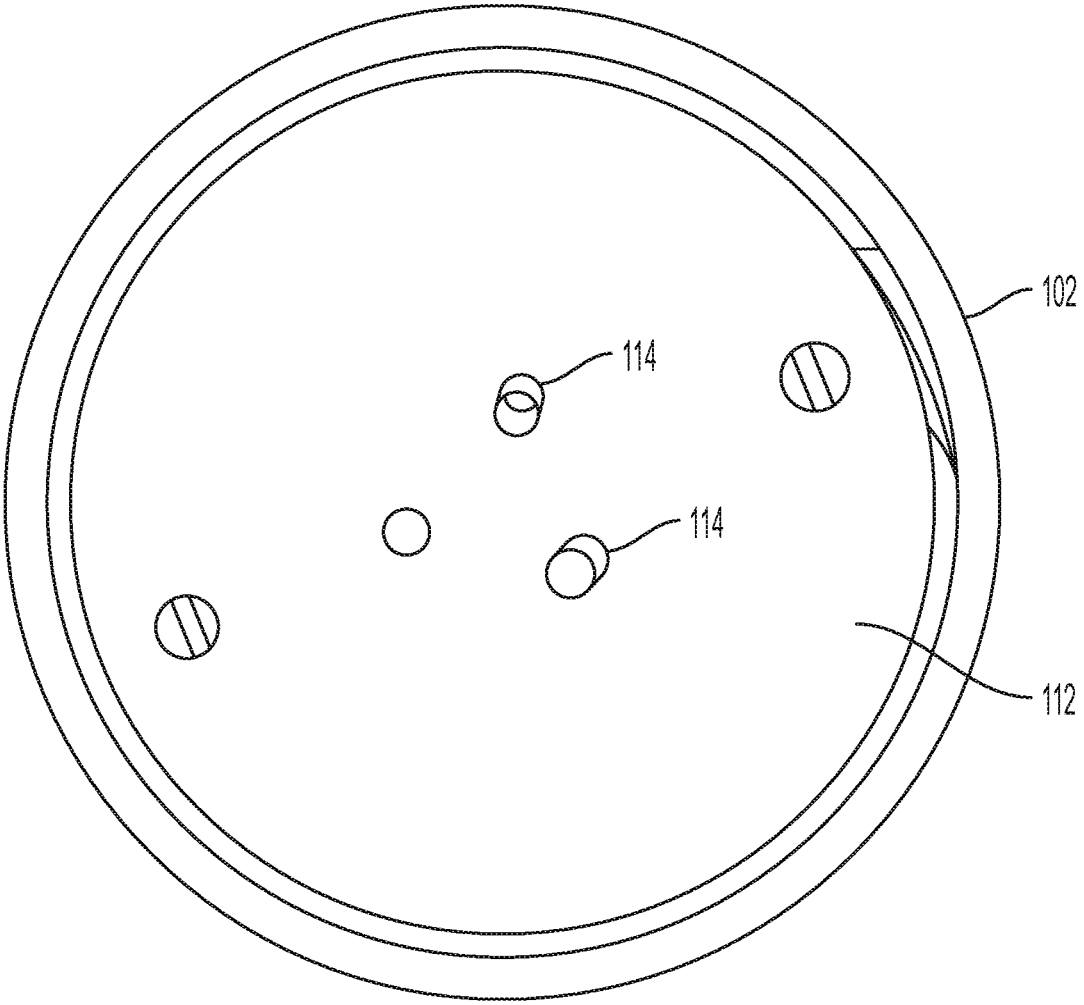
FIG. 3 is a top view of a lighting device assembly according to an example embodiment.

In various embodiments, the heat sink 108 may be unitary formed (e.g., cast) with the top member 112, or may be connected (or attached) to the top member 112 to contact the top member 112. In this case, an opposite end of the top member 112 may be exposed, for example, as shown in FIG. 3, so that when the lighting device assembly 100 is attached (or mounted) to a surface of an object 132 as shown in FIG. 1B (or the fixture housing 105 as shown in FIGS. 1C and 1D), for example, the heat sink 108 may be arranged in heat-transfer communication with the object 132 (or fixture housing 105) via the top member 112, to conduct heat away from the light source of the light source assembly 106 to the object 132. In an example embodiment, the top member 112 may be arranged in direct contact with the surface of the object 132 (or a surface of the fixture housing 105). In this case the object (e.g., a fixture housing) 132 may be made of any suitable material, composition, or layers thereof having suitable thermal conductance and/or heat dissipation characteristics, for example, such as copper, aluminum, steel, and/or the like. In some embodiments, the object 132 may include, for example, heat pipes, peltier coolers, fan/heatsink combo, water cooling systems, refrigerant systems, and/or the like.

The top member 112 may enclose the top of the housing member 102. For example, the top member 112 may include threading that mates with threading of the housing member 102, to be twist-locked on the housing member 102. However, the present invention is not limited thereto, and the top member 112 may enclose or connect to the top of the housing member 102 via any suitable method, such as, but not limited to, mating tabs and/or grooves, clips, screws, nails, adhesives, welding, combinations thereof, or the like. As shown in FIG. 3, in various embodiments, an end of the top member 112 may be exposed to directly contact the surface of the object 132 (or a surface of the fixture housing 105). Accordingly, through the top member 112, the heat sink 108 may be in close relation with (or contact) a surface of an object on which the lighting device assembly 100 is mounted, and may conduct heat from the light source assembly 106 to the surface of the object.

Figure 4:
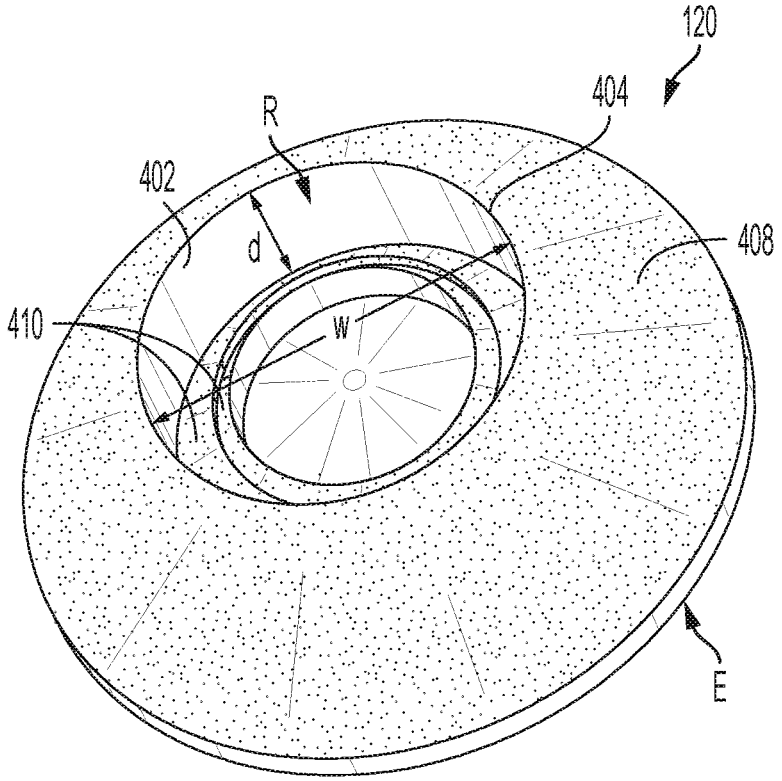
FIG. 4 is a perspective view of an optic of a lighting device assembly according to an example embodiment.

FIG. 4 is a perspective view of an optic of a lighting device assembly according to an example embodiment of the present invention. Referring to FIG. 4, the optic 120 includes a recess R. In various embodiments, the light source of the light source assembly 106 is extended toward the recess R of the optic 120 by the heat sink 108 to emit light towards the recess R of the optic 120. In various embodiments, the optic 120 is configured to shift (or adjust) a direction of the light emitted from the light source from a first direction to a second direction. In various embodiments, the light source of the light source assembly 106 and the heat sink 108 remains stationary relative to the housing member 102, such that the optic 120 may freely move and pivot relative to and around the light source of the light source assembly 106 and the heat sink 108.

In various embodiments, the optic 120 includes a side wall 402 having a top edge 404 that defines the recess R. A focal point of the optic 120 may be located within a depth d of the recess R, and the recess R may have a diameter (or width) w. In various embodiments, the width (or diameter) w of the recess R may be greater than or equal to the width (or diameter) of the heat sink 108, and may limit a maximum degree amount (e.g., 10°, 30°, 45°, and the like) that the optic 120 can pivot about the light source assembly 106. For example, the maximum degree amount that the optic 120 may pivot about the light source assembly 106 may correspond to the width w of the recess R and a width (or diameter) of the heat sink 108 within the recess R, such that the optic 120 may pivot about the light source assembly 106 until the top edge 404 of the recess R contacts a side wall of the heat sink 108. However, in other embodiments, the width w of the recess R may be smaller than the width (or diameter) of the heat sink 108.

In some embodiments, an upper surface 408 of the optic 120 may include a reflective surface (e.g., provided by a layer or coating of reflective material, contours, or combination thereof) to reflect light towards an emitting surface E of the optic 120. In various embodiments, the bottom surface of the recess R of the optic 120 may include one or more reflective elements 410 to reflect light towards the emitting surface E of the optic 120. In some embodiments, each of the reflective elements 410 may have an inner annular side surface that is perpendicular or substantially perpendicular to a focal axis of the optic 120, and an outer annular side surface that is angled relative to the focal axis of the optic 120. The angle of the outer annular side surface of each of the reflective elements 410 may slope downward (e.g., towards the emitting surface E) and outward (e.g., towards the sidewall 402). In some embodiments, the outer annular side surface may include a reflective surface (e.g., provided by a layer or coating of reflective material, contours, or combination thereof), to reflect light towards the emitting surface E of the optic 120. However, the present invention is not limited thereto, and the reflective elements 410 may be omitted or may have different shapes.

In some embodiments, the optic 120 may define (or shape) a light field of light emitted through the emitting surface E of the optic 120. For example, in some embodiments, the reflective elements 410 may be configured to refract a portion of incident light that is emitted by the light source of the light source assembly 106 at an angle that is greater than or equal to a critical angle (or critical angle of incidence) with respect to a normal of (perpendicular line from) the emitting surface E of the optic 120. The refracted light may be internally reflected off of the emitting surface E, into and absorbed by other portions (non-transparent portions) of the lighting device (e.g., the housing member 102) 100. However, the portion of the incident light emitted by the light source at an angle that is less than the critical angle passes through the emitting surface E (as emitted light), such that light that is transmitted through the emitting surface E may have an outer light field (area of significantly reduced intensity) that is relatively small and/or more defined.

In some embodiments, the reflective elements 410 may have a size and/or shape depending, at least in part, on the refractive index of the material used to form the reflective elements 410 and the desired critical angle for internally reflecting light. For example, in some embodiments, the reflective elements 410 may include or be formed of a material having a refractive index of about 1.4 (or 1.4) to about 1.6 (or 1.6) to refract the incident light at a critical angle of about 39 degrees (or 39 degrees) or greater. In other embodiments, materials having other suitable refractive indices or that define other suitable critical angles may be employed.

Accordingly, in various embodiments, the optic 120 having the reflective elements 410 may define (by size or shape, or both) a light field of light emitted through the emitting surface E of the optic 120, by internally reflecting a portion of the light that is emitted by the light source toward a periphery of the optic 120 to be absorbed by the lighting device (e.g., housing member 102). For example, in some embodiments, at least some portion of the light emitted from the light source is incident on the reflective elements 410, and is refracted by the reflective elements 410 at an angle greater than or equal to the critical angle (relative to the emitting surface E). The refracted light is internally reflected by the emitting surface E and absorbed by the lighting device. At least some portion of the light incident on inner surfaces of the optic 120 is refracted at an angle that is less than the critical angle, so as to pass through the optic 120 and be emitted out from the emitting surface E. The light that is emitted through the emitting surface E may have a light field that is reduced and/or more defined (as compared to lighting devices that do not employ an optic configured as described herein).

FIG. 5A is a cross-sectional view of the lighting device 100 shown in FIG. 2A with the optic in a first position according to an embodiment of the present invention, and FIG. 5B is a cross-sectional view of the lighting device with the optic in a second position according to an embodiment of the present invention. Referring to FIGS. 2A, 4, 5A, and 5B, the lighting device assembly 100 includes the housing member 102, the optic assembly 104 held in the cavity of the housing member 102, the light source assembly 106, the heat sink 108, and the top member 112. The heat sink 108 and the top member 112 is unitarily formed (e.g., cast), and one end of the top member 112 is mounted to contact a surface of the object (e.g., a fixture housing) 132. The light source assembly 106 is attached (e.g., mounted) at an end of the heat sink 108, such that the heat sink 108 transfers heat from the light source assembly 106 to the object 132 through the top member 112. Accordingly, the heat sink 108 may conduct heat away from the light source assembly 106 directly to the object 132. The other end of the heat sink 108 on which the light source assembly 106 is attached (e.g., mounted) extends at least partially within the opening of the locking member 122 towards the recess of the optic 120. Accordingly, the light source assembly 106 can emit light toward the recess R of the optic 120, and the optic 120 may freely move and pivot about the light source assembly 106 and the heat sink 108.

As shown in FIGS. 5A and 5B, the light source assembly 106 and the heat sink 108 may be stationary relative to the housing member 102 and/or the object 132, while the optic 120 may freely move and pivot about the light source assembly 106 and the heat sink 108. When the optic assembly 104 is pivoted from the first position to the second position, the exterior surface of the holding member 118 slideably engages with the cavity of the housing member 102. Similarly, the exterior surface of the upper member of the locking member 112 slideably engages with the elastic member 110 (e.g., the eye of the elastic member 110). The elastic member 110 presses the optic assembly 104 towards the cavity of the housing member 102, and thus, maintains (or holds) the pivoted position of the optic 120 against movement by gravity. According to an example embodiment, the optic assembly 104 may be pressed toward the elastic member 110 during the adjustable movement of the optic 120, and the elastic member 110 may apply an opposite force on the optic assembly 104 to press the optic assembly 104 into the cavity of the housing member 102 to hold the desired position. In some embodiments, at least one of the outer surface of the holding member 118 and the surface of the cavity of the housing member 102 may include a friction member or layer, so that engaging surfaces can be further restricted from movement.

In various embodiments, the light source assembly 106 extends at least partially within the opening of the locking member 122 toward the recess R of the optic 120 in each of the first position and the second position of the optic 120, and the light source assembly 106 and the heat sink 108 may be stationary relative to the housing member 102 and/or the object 132, such that the optic 120 can freely move and pivot about the light source assembly 106 and the heat sink 108. In some embodiments, the maximum amount or degree that the optic 120 can pivot about the light source assembly 106 and the heat sink 108 may be limited by the width (or diameter) w of the recess R and/or the width (or diameter) of the side wall of the heat sink 108. For example, as shown in FIG. 5B, the maximum amount or degree that the optic 120 can pivot may be limited by the width (or diameter) of the side wall of the heat sink 108. Thus, by reducing the width (or diameter) of a portion of the heat sink 108 that interferes with the movement of the optic assembly 104 (e.g., by the locking member 112), the adjustable movement of the optic 120 may be improved. In this case, as shown in FIG. 5B, the degree amount that the optic 120 may pivot may reach its maximum when the top edge of the locking member 112 contacts the sidewall of the heat sink 108 (or surface of the top member 112) or when the top edge 404 of the recess R contacts the sidewall of the heat sink 108.

FIG. 6A is a cross-sectional view of the lighting device 100 shown in FIG. 2B with the optic in a first position according to an embodiment of the present invention, and FIG. 6B is a cross-sectional view of the lighting device with the optic in a second position according to an embodiment of the present invention. Referring to FIGS. 2B, 4, 6A, and 6B, the lighting device assembly 100 includes the housing member 102, the optic assembly 204 held in the cavity of the housing member 102, the light source assembly 106, the heat sink 108, and the top member 112. The heat sink 108 and the top member 112 is unitarily formed (e.g., cast), and one end of the top member 112 is mounted to contact a surface of the object (e.g., a fixture housing) 132. The light source assembly 106 is attached (e.g., mounted) at an end of the heat sink 108, such that the heat sink 108 transfers heat from the light source assembly 106 to the object 132 through the top member 112. Accordingly, the heat sink 108 may conduct heat away from the light source assembly 106 directly to the object 132. The other end of the heat sink 108 on which the light source assembly 106 is attached (e.g., mounted) extends at least partially within the opening of the locking member 222 towards the recess of the optic 120. Accordingly, the light source assembly 106 can emit light toward the recess R of the optic 120, and the optic 120 may freely move and pivot about the light source assembly 106 and the heat sink 108.

As shown in FIGS. 6A and 6B, the light source assembly 106 and the heat sink 108 may be stationary relative to the housing member 102 and/or the object 132, while the optic 120 may freely move and pivot about the light source assembly 106 and the heat sink 108. When the optic assembly 204 is pivoted from the first position to the second position, the lower surface portion of the exterior surface of the holding member 218 slideably engages with the cavity of the housing member 102. Similarly, the upper surface portion of the exterior surface of the holding member 218 slideably engages with the elastic member 110 (e.g., the eye of the elastic member 110). The elastic member 110 presses the optic assembly 204 towards the cavity of the housing member 102, and thus, maintains (or holds) the pivoted position of the optic 120 against movement by gravity. According to an example embodiment, the optic assembly 204 may be pressed toward the elastic member 110 during the adjustable movement of the optic 120, and the elastic member 110 may apply an opposite force on the optic assembly 204 to press the optic assembly 104 into the cavity of the housing member 102 to hold the desired position. In some embodiments, at least one of the outer surface of the holding member 218 and the surface of the cavity of the housing member 102 may include a friction member or layer, so that engaging surfaces can be further restricted from movement.

In various embodiments, the light source assembly 106 extends at least partially within the opening of the locking member 222 toward the recess R of the optic 120 in each of the first position and the second position of the optic 120, and the light source assembly 106 and the heat sink 108 may be stationary relative to the housing member 102 and/or the object 132, such that the optic 120 can freely move and pivot about the light source assembly 106 and the heat sink 108. In some embodiments, the maximum amount or degree that the optic 120 can pivot about the light source assembly 106 and the heat sink 108 may be limited by the width (or diameter) w of the recess R and/or the width (or diameter) of the side wall of the heat sink 108. For example, as shown in FIG. 6B, the heat sink 108 does not interfere with the movement of the optic assembly 104 (e.g., by the locking member 222 and/or the holding member 218). Thus, the width (or diameter) of the heat sink 108 may be constant or substantially constant along its length. On the other hand, the maximum amount or degree that the optic 120 can pivot may be limited by the width (or diameter) w of the recess of the optic 120. For example, as shown in FIG. 6B, the degree amount that the optic 120 may pivot may reach its maximum when the top edge 404 of the recess R contacts the sidewall of the heat sink 108. Accordingly, the width w (see FIG. 4) of recess R may be greater than or equal to the width of the heat sink 108 according to the desired maximum degree amount of pivot.

As discussed above, in various embodiments, heat may be transferred from the light source directly to a surface of an object (e.g., fixture housing) via the heat sink and the top member, and thus, heat transferred from the light source may be improved, and brightness of the light source may be improved. Further, in various embodiments, the optic may move (e.g., pivot and/or rotate) freely about a stationary light source and heat sink, while maintain (or holding) a desired position by pressing the optic assembly towards a cavity of the housing member via an elastic member. Accordingly, adjustability of the optic may be simplified or improved by allowing adjustment of the optic without having disassemble or loosen the components within the lighting device assembly.

The foregoing description of illustrative embodiments has been presented for purposes of illustration and of description. It is not intended to be exhaustive or limiting, and modifications and variations may be possible in light of the above teachings or may be acquired from practice of the disclosed embodiments. Various modifications and changes that come within the meaning and range of equivalency of the claims are intended to be within the scope of the invention. Thus, while certain embodiments of the present invention have been illustrated and described, it is understood by those of ordinary skill in the art that certain modifications and changes can be made to the described embodiments without departing from the spirit and scope of the present invention as defined by the following claims, and equivalents thereof.

What is claimed:

1. A lighting device assembly comprising:

a top member;

a heat sink extending from the top member in heat transfer communication with the top member, the heat sink being in a fixed relation with the top member;

a light source attached to a first end of the heat sink in heat transfer communication with the heat sink;

an optic assembly having an optic and configured to pivot the optic about the light source to an adjusted position of a plurality of possible adjusted positions, each possible adjusted position having a different pivot position relative to the light source;

a bias member configured to impart a bias force on the optic assembly to maintain the optic assembly in any one of the plurality of possible adjusted positions of the optic wherein the bias member comprises a spring that is arranged at least partially around the heat sink.

2. The lighting device assembly of claim 1, wherein the heat sink and the top member are a unitary cast member.

3. The lighting device assembly of claim 1, wherein the heat sink extends from a first side of the top member, a second side of the top member is exposed to allow the second side of the top member to contact an object for transferring heat to the object when the lighting device is installed.

4. The lighting device assembly of claim 3, wherein the second side of the top member faces opposite to the first side of the top member.

5. The lighting device assembly of claim 1, wherein the heat sink extends from a first side of the top member, and wherein a second side of the top member is exposed to allow the second side of the top member to contact a fixture housing for transferring heat to the fixture housing when the lighting device is installed in the fixture housing.

6. The lighting device assembly of claim 1, further including a fixture housing configured to be mounted in a mounting space, wherein the heat sink extends from a first side of the top member, and wherein a second side of the top member is in contact with the fixture housing for transferring heat to the fixture housing.

7. The lighting device assembly of claim 6, wherein the fixture housing includes an isolation body configured to house the top member of the lighting device assembly and one or more top members of one or more lighting device assemblies.

8. The lighting device assembly of claim 6, wherein the fixture housing includes an isolation body having a plurality of expandable or collapsible members for adjusting the isolation body to be installed in any one of a plurality of different spaces.

9. The lighting device assembly of claim 1, wherein the heat sink has a length dimension that extends from the top member, the heat sink has a first circumferential size on the one end on which the light source is attached, the heat sink has a second circumferential size along a portion of the length dimension between the top member and the one end, the second circumferential size is smaller than the first circumferential size to allow for a greater pivotal movement than would be allowed with the second circumferential size being equal or greater than the first circumferential size.

10. The lighting device assembly of claim 9, wherein the bias member comprises a spring that is arranged at least partially around the portion of the length dimension having the second circumferential size.

11. The lighting device assembly of claim 1, further including a housing member that is configured to selectively connect to and disconnect from the top member, and to enclose the heat sink and light source when connected to the top member.

12. The lighting device assembly of claim 11, wherein the housing member has a cylindrical shape.

13. The lighting device assembly of claim 11, wherein the housing member has a partially spherical shape.

14. The lighting device assembly of claim 1, further including a housing member having threading that mates with a threading on the top member to selectively connect to and disconnect from the top member, and to enclose the heat sink and light source when connected to the top member.

15. The lighting device assembly of claim 1, wherein the optic assembly is configured to pivot the optic about multiple pivot axes, relative to the light source.

16. A lighting device assembly comprising:

a top member having a first side and a second side facing opposite the first side;

a heat sink formed unitary with and extending from the first side of the top member in heat transfer communication with the top member, the heat sink being in a fixed relation with the top member;

a light source attached to a first end of the heat sink in heat transfer communication with the heat sink;

an optic assembly having an optic and configured to pivot the optic about the light source to an adjusted position of a plurality of possible adjusted positions, each possible adjusted position having a different pivot position relative to the light source;

a bias member configured to impart a bias force on the optic assembly to maintain the optic assembly in any one of the plurality of possible adjusted positions of the optic; and a fixture housing in contact with the second side of the top member in heat transfer communication with the second side of the top member wherein the bias member comprises a spring that is arranged at least partially around the heat sink.

17. The lighting device assembly of claim 16, wherein the heat sink has a length dimension that extends from the top member, the heat sink has a first circumferential size on the one end on which the light source is attached, the heat sink has a second circumferential size along a portion of the length dimension between the top member and the one end, the second circumferential size is smaller than the first circumferential size to allow for a greater pivotal movement than would be allowed with the second circumferential size being equal or greater than the first circumferential size.

18. The lighting device assembly of claim 17, wherein the bias member comprises a spring that is arranged at least partially around the portion of the length dimension having the second circumferential size.

* * * * *